US005917399A

United States Patent [19]

Ishii

[11] Patent Number: 5,917,399

[45] Date of Patent: Jun. 29, 1999

[54] METHOD FOR ADJUSTING PRE-ARCING TIME-CURRENT CHARACTERISTIC OF FUSE AND FUSE STRUCTURE THEREFOR

[75] Inventor: Takashi Ishii, Shizuoka, Japan

[73] Assignee: Yazaki Corporation, Tokyo, Japan

[21] Appl. No.: 08/985,087

[22] Filed: Dec. 4, 1997

[30] Foreign Application Priority Data

Dec. 5, 1996 [JP] Japan ..... 8-325543

[51] Int. Cl.[6] ..... H01H 85/04

[52] U.S. Cl. ..... 337/290; 337/142; 337/198; 337/292; 337/416

[58] Field of Search ..... 337/142, 273, 337/274–282, 290, 292, 198, 416; 439/621, 622

[56] References Cited

U.S. PATENT DOCUMENTS 4,358,747 11/1982 Zlupko et al. ..... 337/273
4,626,817 12/1986 Cameron ..... 337/162

FOREIGN PATENT DOCUMENTS 56-52 1/1981 Japan .
57-64049 4/1982 Japan .
59-23141 2/1984 Japan .

*Primary Examiner*—Leo P. Picard
*Assistant Examiner*—Jayprakash N. Gandhi
*Attorney, Agent, or Firm*—Sughrue, Mion, Zinn, Macpeak & Seas, PLLC

[57] ABSTRACT

A method of adjusting pre-arcing time-current characteristic for a fuse is performed in a manner that a fusible portion I serving in a dead short-circuit area and a fusible portion II serving in a rare short-circuit area are coupled in series to form a fuse element, and entire pre-arcing time-current characteristic for the fuse is adjusted by combining pre-arcing time-current characteristic of the respective fusible portions I and II. A fuse structure is formed by a fusible portion I serving in a dead short-circuit, and a fusible portion II serving in a rare short-circuit area coupled in series with the fusible portion I serving in a dead short-circuit area. The fusible portion II serving in a rare short-circuit area is formed by material which is different in conductivity and melting point from those of material forming the fusible portion I serving in a dead short-circuit area.

5 Claims, 4 Drawing Sheets

METHOD FOR ADJUSTING PRE-ARCING TIME-CURRENT CHARACTERISTIC OF FUSE AND FUSE STRUCTURE THEREFOR

BACKGROUND OF THE INVENTION

The present invention relates to a method of adjusting the pre-arcing time-current characteristic for a fuse and a fuse structure therefor.

Conventionally, an electric circuit for an automobile, etc. employs a fuse 1 as shown in FIG. 6 for protecting electric wires, devices, etc. from an excess current. The fuse 1 is formed in a manner that a pair of terminals 3 are coupled through a fuse element 5, both the terminals and the fuse element thus coupled are mounted within an insulative heat-resistant resin housing 7, and the upper potion 9 of the housing 7 is closed by a transparent cover 11. Accordingly, it is possible to visually confirm through the transparent cover 11 whether or not the fuse element 5 received within the housing 7 is fused or melted.

The fuse element 5 has a fusible portion formed by low melting point metal such as lead or tin which melts or fuses due to heat generated by the fuse element 5 when a current more than the rated current of the fuse element flows therethrough. When the fusible portion melts, the circuit connected to the fuse is opened thereby to protect the electric wires and the devices. Conventionally, the pre-arcing time-current characteristic of the fusible portion has been adjusted by changing the size (that is, the resistance value) of the fusible portion thereby to change an amount of heat generated therefrom.

A fuse has in general a constant relative relation between the conduction current and the pre-arcing time. That is, the fusible portion of the fuse melts immediately when there flows a current not less than twice as large as the rated current of the fuse (that is, dead short-circuit current). In contrast, the fusible portion of the fuse element 5 repeatedly generates and discharges heat when there flows a short-circuit current not more than twice as large as the rated current of the fuse or an intermittent short-circuit current (that is, rare short-circuit current). Accordingly, in this case, the pre-arcing time tends to become longer. Under such a circumstance, since the electric wires forming the circuits are covered by the insulating coating, unlike the fusible portion, the electric wires can not discharge the heat therefrom when the short-circuit current flows intermittently therethrough. As a consequence, the temperature of the electric wires increases continuously due to the accumulated heat therein, and so smoke, etc. may be generated from the electric wires if worst comes to worst.

However, according to the conventional adjusting method for the pre-arcing time-current characteristic, the pre-arcing time-current characteristic has been adjusted only by changing the size of the fusible portion. Accordingly, in order to solve the aforesaid problem, even if the size of the fusible portion is changed so as to change only the pre-arcing time-current characteristic in the rare short-circuit area shown in FIG. 7 from a characteristic curve A to a characteristic curve B, the pre-arcing time-current characteristic in the dead short-circuit area changes also from the characteristic curve A to a characteristic curve C. As a consequence, there arises a problem that a desired pre-arcing time-current characteristic can not be obtained.

SUMMARY OF THE INVENTION

The present invention has been made so as to obviate the aforesaid problem, and an object of the present invention is to provide a method of adjusting the pre-arcing time-current characteristic for a fuse and a fuse structure therefor which are capable of separately changing the pre-arcing time-current characteristic both in the rare short-circuit area and the dead short-circuit area.

In order to achieve the aforesaid object, a method of adjusting pre-arcing time-current characteristic for a fuse according to the present invention is characterized in that a fusible portion serving in a dead short-circuit area and a fusible portion serving in a rare short-circuit area are coupled in series to form a fuse element, and entire pre-arcing time-current characteristic for the fuse is adjusted by combining pre-arcing time-current characteristic of the respective fusible portions.

A fuse structure according to the present invention is characterized by comprising a fusible portion serving in a dead short-circuit area, and a fusible portion serving in a rare short-circuit area coupled in series with the fusible portion serving in a dead short-circuit area, wherein the fusible portion serving in a rare short-circuit area is formed by material which is different in conductivity and melting point from those of material forming the fusible portion serving in a dead short-circuit area.

The fuse structure may be characterized in that the fusible portion serving in a dead short-circuit area is provided with a heat radiation plate.

According to such a method of adjusting the pre-arcing time-current characteristic for the fuse, the fuse element is divided into two fusible portions serving in the dead short-circuit area and the rare short-circuit area, respectively, and the entire pre-arcing time-current characteristic for the fuse is adjusted by combining the pre-arcing time-current characteristic of the respective fusible portions. Accordingly, the pre-arcing time-current characteristic for the fuse in the rare short-circuit area and the dead short-circuit area can be adjusted separately.

According to such a fuse structure, since the fusible portion serving in the dead short-circuit area and the fusible portion serving in the rare short-circuit area are coupled in series, the fusible portion serving in the dead short-circuit area is fused in the dead short-circuit area where a large current flows, while the fusible portion serving in the rare short-circuit is fused in the rare short-circuit area where a small current flows for a long time. In this manner the circuit can be cut off in each of the dead short-circuit area and the rare short-circuit area.

Further, according to the fuse structure having the heat radiation plate at the fusible portion serving in the dead short-circuit area, the temperature increase of the fusible portion serving in the dead short-circuit area can be suppressed as compared with the temperature increase of the fusible portion serving in the rare short-circuit area.

BRIEF DESCRIPTION OF THE INVENTION

DETAILED DESCRIPTION OF THE INVENTION

Preferred embodiments of a method of adjusting the pre-arcing time-current characteristic for a fuse and a fuse structure therefor according to the present invention will be described with reference to the accompanying drawings.

Figure 1:
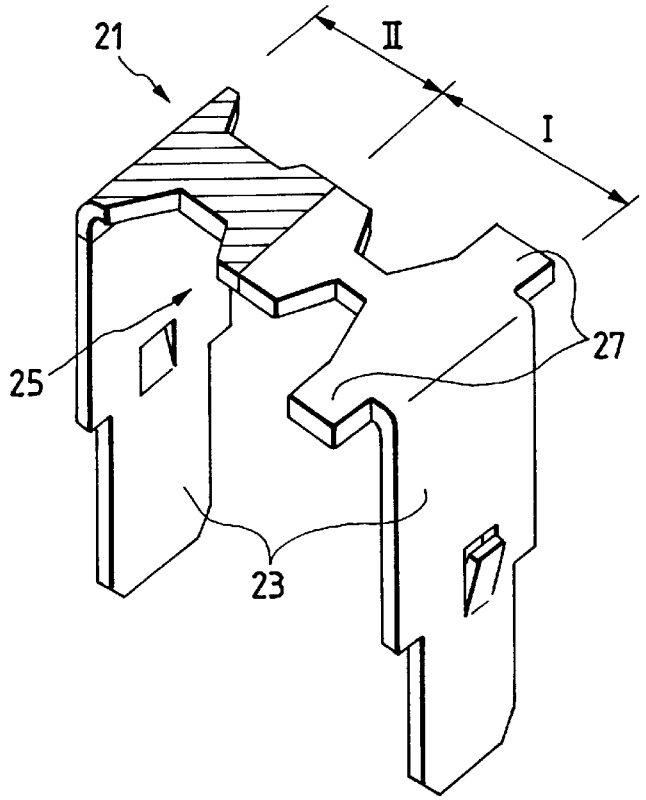
FIG. 1 is a perspective view showing the structure of a fuse according to the present invention.
Figure 2:
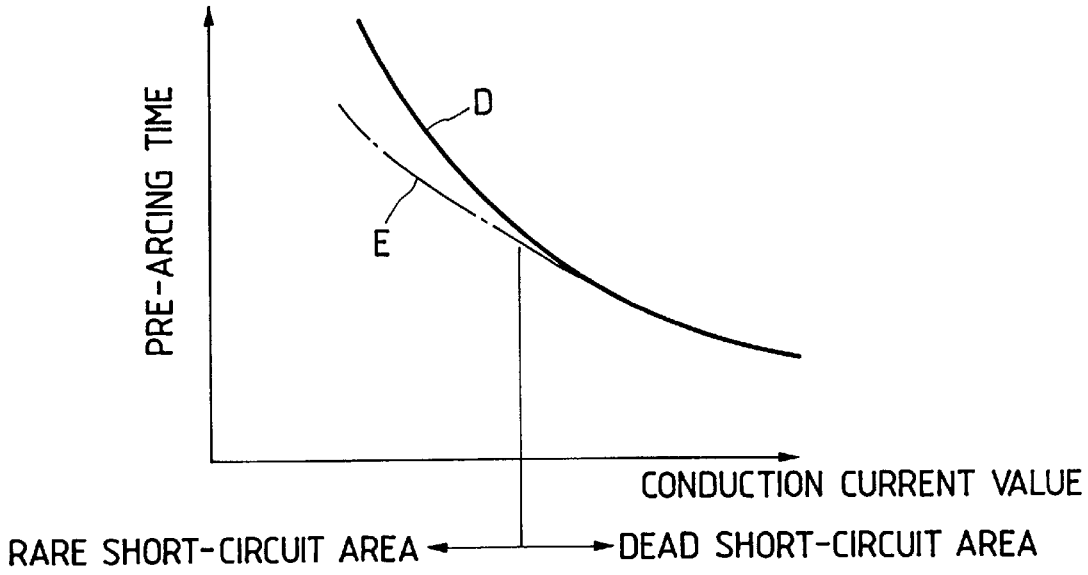
FIG. 2 is a graph showing the pre-arcing time-current characteristic of the fuse structure shown in FIG. 1.

FIG. 1 is a perspective view showing the structure of a fuse according to the present invention, and FIG. 2 is a graph showing the pre-arcing time-current characteristic of the fuse structure shown in FIG. 1.

In the conventional method of adjusting the pre-arcing time-current characteristic for a fuse, the pre-arcing time-current characteristic is adjusted by changing the size (that is, a resistance value) of the fusible portion thereby to change the amount of heat. In contrast, in the method of adjusting the pre-arcing time-current characteristic for a fuse according to the present invention, the fusible portion is divided into a fusible portion serving in a dead short-circuit area and a fusible portion serving in a rare short-circuit area, and the entire pre-arcing time-current characteristic for the fuse is adjusted by combining the pre-arcing time-current characteristic of the respective fusible portions.

As shown in FIG. 1, a fuse 21 is formed by interconnecting a pair of terminals 23 with a fuse element 25. The fuse element 25 is formed by connecting in series a fusible portion I serving in a dead short-circuit area and a fusible portion II serving in a rare short-circuit area. The fusible portion I serving in the dead short-circuit area is provided with a heat radiation plate 27. The fusible portions I and II are formed by fusing elements of different kinds of metal in a manner that the fusing portion I is fused in the dead short-circuit area, while the fusing portion II is fused in the rare short-circuit area.

The fusible portions I and II are set to have the physical values with the relative relationship shown in the following table 1. That is, the fusible portion I serving in the dead short-circuit area has a small conductivity, a large resistivity and a high melting point. In contrast, the fusible portion II serving in the rare short-circuit area has a large conductivity, a small resistivity and a low melting point. Such a fusible portion I may be formed by copper alloy (including about 2% Sn), for example, and such a fusible portion II may be formed by Sn, for example.

TABLE 1

| Fusible portion | Conductivity of material | Resistivity of fusible portion | Melting point of material |
|---|---|---|---|
| I | small | large | high |
| II | large | small | low |

As to the fuse 21, at the time of shortening the pre-arcing time of the fuse in the dead short-circuit area, the size of the fusible portion I is changed. In this case, the pre-arcing time of the fuse in the rare short-circuit area is not changed so long as the size of the fusible portion II is not changed. In contrast, at the time of shortening the pre-arcing time of the fuse in the rare short-circuit area, the size of the fusible portion II is changed. In this case, the pre-arcing time of the fuse in the dead short-circuit area is not changed so long as the size of the fusible portion I is not changed. By adjusting the size of the fusible portions in this manner, the pre-arcing time-current characteristic of the fuse shown by a curve D in FIG. 2 can be changed into the desirable pre-arcing time-current characteristic shown by a curve E.

Figure 3:
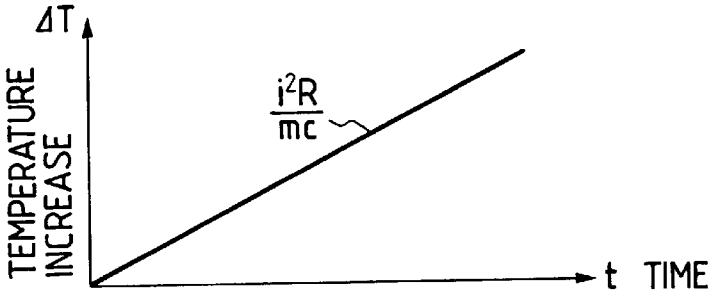
FIG. 3 is a graph for explaining the increase of the temperature of the fusible portion.
Figure 4:
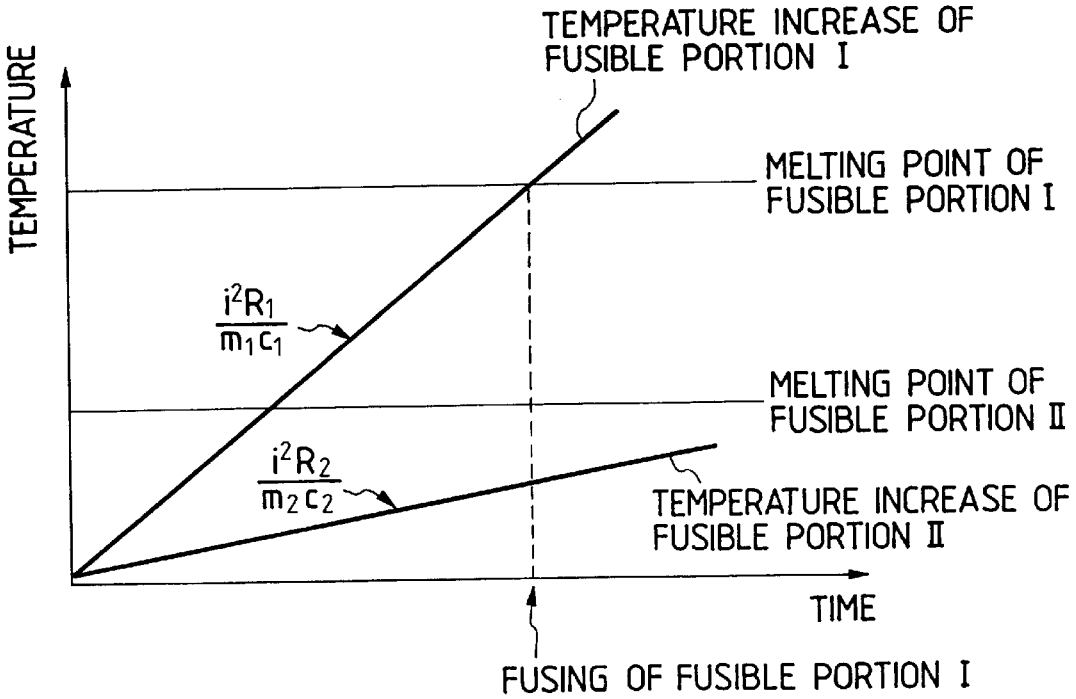
FIG. 4 is a graph for explaining the fusing operation in the dead short-circuit area.
Figure 5:
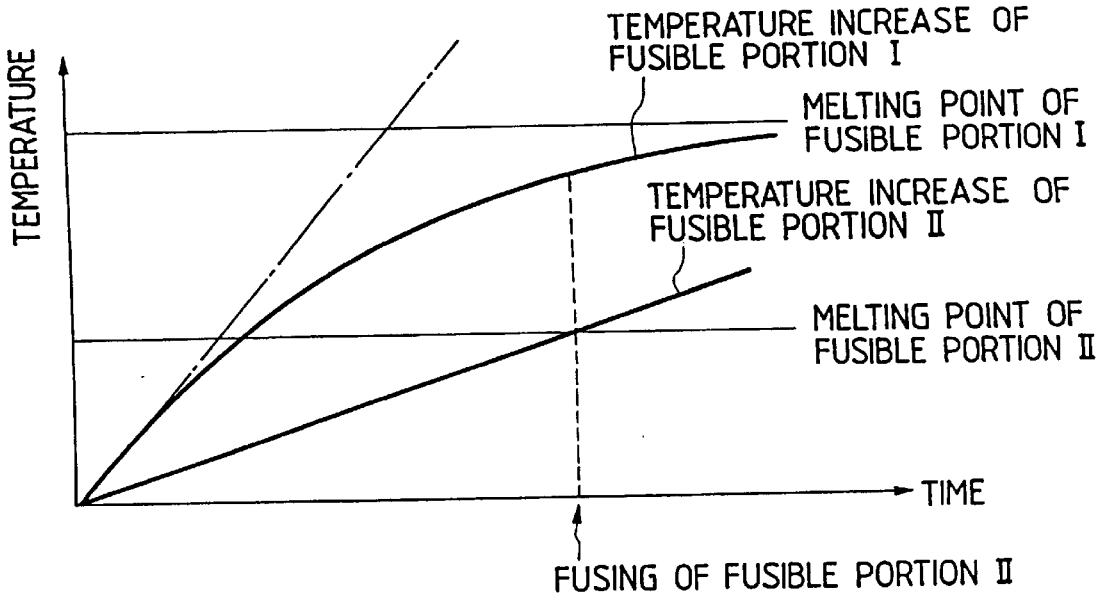
FIG. 5 is a graph for explaining the fusing operation in the rare short-circuit area.
Figure 6:
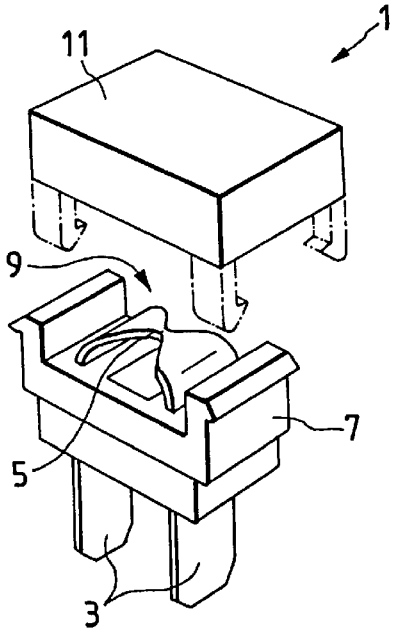
FIG. 6 PRIOR ART
FIG. 6 is a perspective view showing the structure of a conventional fuse.
Figure 7:
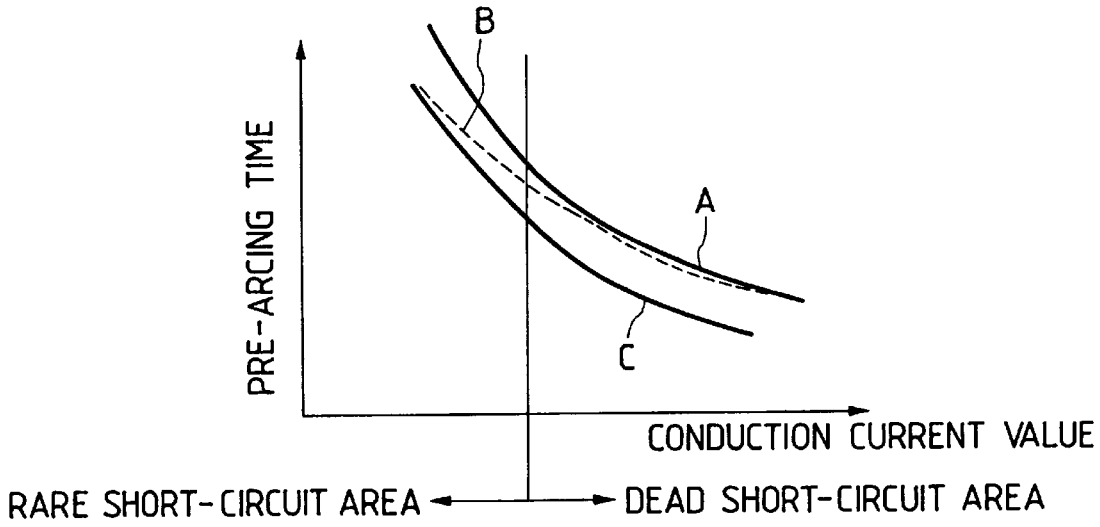
FIG. 7 is a graph showing the pre-arcing time-current characteristic of the conventional fuse structure.

The function of the fuse structure fabricated by the aforesaid method for adjusting the pre-arcing time-current characteristic will be explained with reference to FIGS. 3 to 5. FIG. 3 is a graph for explaining the increase of the temperature of the fusible portion, FIG. 4 is a graph for explaining the fusing operation in the dead short-circuit area, and FIG. 5 is a graph for explaining the fusing operation in the rare short-circuit area.

The calorific value Q of the fusible portions (fusible portion I, fusible portion II) can be represented by the following expressions 1 and 2.

$$Q=i^2\times R\times t \qquad \text{expression 1}$$

where i represents a current value (A), R represents an electric resistance (Ω), and t represents a time.

$$Q=m\times c\times \Delta T \qquad \text{expression 2}$$

where m represents a mass (g), c represents a specific heat (cal/g×degree), and ΔT represents increased temperature (degree).

From the expressions 1 and 2, the following relationship can be obtained.

$$m\times c\times \Delta T=i^2\times R\times t$$

$$\Delta T=[(i^2\times R)/(m\times c)]t$$

Accordingly, the temperature increase ΔT of the fusible portion can be obtained as the linear function of the time t with the coefficient $(i^2\times R)/(m\times c)$ as shown in FIG. 3.

Since the temperature increase of the fusible portion can be expressed in this manner, in the case of the dead short-circuit area where a large current flows, the fusible portion I reaches the melting point thereof prior to the fusible portion II and so the fusible portion I fuses prior to the fusible portion II as shown in FIG. 4 when the value $(i^2\times R1)/(m1\times c1)$ of the fusible portion I is adjusted to be larger than the value $(i^2\times R2)/(m2\times c2)$ of the fusible portion II. In this case, although the temperature of the fusible portion II also increases, the increasing rate of the temperature of the fusible portion II is smaller than that of the fusible portion I, the fusible portion II does not reach the melting point thereof prior to the fusible portion I.

In the case of the rare short-circuit area where the fusible portion fuses by flowing a small current for a long time therethrough, the fusible portion I does not heat sufficiently and the temperature increase of the fusible portion I is suppressed by the heat radiation plate 27 as shown in FIG. 5. In contrast, since the fusible portion II can not attain sufficient heat radiation effect, the fusible portion II gradually accumulates the heat and so reaches the melting point thereof and melts prior to the fusible portion I. The fusible portion I may not be provided with the heat radiation plate 27 so long as the resistance value R1, melting point, mass ml and specific heat cl thereof are adjusted and a predetermined amount of natural heat radiation is obtained thereby to attain the temperature increase characteristic substantially same as that shown in FIG. 5.

In this manner, according to the aforesaid method of adjusting the pre-arcing time-current characteristic for the fuse, the fuse element 25 is divided into two fusible portions I and II serving in the dead short-circuit area and the rare short-circuit area, respectively, and the entire pre-arcing time-current characteristic for the fuse is adjusted by combining the pre-arcing time-current characteristic of the respective fusible portions I and II. Accordingly, the mutual action between the rare short-circuit area and the dead short-circuit area can be eliminated at the time of adjusting the pre-arcing time-current characteristic for the fuse, and so a desirable pre-arcing time-current characteristic for the fuse can be obtained.

Further, according to the aforesaid fuse structure, the fusible portions I and II formed by different materials are coupled in series, and the fusible portion I is arranged to serve in the dead short-circuit area and the fusible portion II is arranged to serve in the rare short-circuit area. Thus, the circuit can be cut off by the fusing of either one of the fusible portions I and II serving in the dead short-circuit area and the rare short-circuit area, respectively. As a consequence, although in the conventional fuse structure, the pre-arcing time tends to become longer in the rare short-circuit area in which the fusible portions do not generate heat sufficiently, in the present invention, the pre-arcing time in the rare short-circuit area can be made shorter without changing the pre-arcing shoe-current characteristic in the dead short-circuit area.

As described above in detail, according to the method of adjusting the pre-arcing time-current characteristic for the fuse of the present invention, the fuse element is divided into two fusible portions serving in the dead short-circuit area and the rare short-circuit area, respectively, and the entire pre-arcing time-current characteristic for the fuse is adjusted by combining the pre-arcing time-current characteristic of the respective fusible portions. Accordingly, the pre-arcing time-current characteristic for the fuse in the rare short-circuit area and the dead short-circuit area can be adjusted separately, and so a desirable pre-arcing time-current characteristic for the fuse can be obtained.

Further, according to the fuse structure of the present invention, since the fusible portion serving in the dead short-circuit area and the fusible portion serving in the rare short-circuit area are coupled in series, the circuit can be cut off in each of the dead short-circuit area where a large current flows and the rare short-circuit area where the fusible portion fuses by flowing a small current for a long time. As a consequence, although in the conventional fuse structure, the pre-arcing time in the rare short-circuit tends to become longer, in the present invention, the pre-arcing time in the rare short-circuit area can be made shorter.

Further, according to the fuse structure having the heat radiation plate at the fusible portion serving in the dead short-circuit area, the temperature increase of the fusible portion serving in the dead short-circuit area can be suppressed. As a consequence, the pre-arcing time-current characteristic of the fusible portion serving in the rare short-circuit area can be extracted remarkably.

What is claimed is:

1. A method of adjusting a pre-arcing time-current characteristic for a fuse, comprising the steps of:

coupling a fusible portion serving in a dead short-circuit area with a fusible portion serving in a rare short-circuit area in series to form a fuse element; and adjusting an entire pre-arcing time-current characteristic for said fuse by combining pre-arcing time-current characteristics of the respective fusible portions.

2. A fuse structure comprising:

a fusible portion serving in a dead short-circuit area;

a fusible portion serving in a rare short-circuit area, said fusible portion serving in a rare short-circuit area being formed of a material which is different in conductivity and melting point from those of a material forming said fusible portion serving in a dead short-circuit area; and a pair of terminals, said pair of terminals having two terminal ends;

wherein a first side of said fusible portion serving in a dead short-circuit area is coupled to a first side of said fusible portion serving in a rare short-circuit area, and a second side of said fusible portion serving in a dead short-circuit area and a second side of said fusible portion serving in a rare short-circuit area are respectively coupled to a corresponding one of said terminal ends, such that said fusible portion serving in a rare short-circuit area is coupled in series with said fusible portion serving in a dead short-circuit area.

3. A fuse structure according to claim 2, wherein said fusible portion serving in a dead short-circuit area is provided with a heat radiation plate.

4. A fuse structure according to claim 2, wherein a conductivity of the material forming said fusible portion serving in a rare short-circuit area is larger than that of the material forming said fusible portion serving in a dead short-circuit area.

5. A fuse structure according to claim 2, wherein a melting point of the material forming said fusible portion serving in a rare short-circuit area is lower than that of the material forming said fusible portion serving in a dead short-circuit area.

* * * * *